US006168448B1

(12) United States Patent
Chang

(10) Patent No.: US 6,168,448 B1
(45) Date of Patent: Jan. 2, 2001

(54) AUDIO JACK CONNECTOR

(75) Inventor: Yao-Hao Chang, Chung-Ho (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/421,448

(22) Filed: Oct. 19, 1999

(30) Foreign Application Priority Data

Jul. 6, 1999 (TW) ..... 88211236

(51) Int. Cl.[7] ..... H01R 29/00
(52) U.S. Cl. ..... 439/188; 439/939
(58) Field of Search ..... 439/188, 939, 439/944

(56) References Cited

U.S. PATENT DOCUMENTS 5,326,280 * 7/1994 Briones et al. ..... 439/939
5,340,325 * 8/1994 Pai ..... 439/944
5,695,362 * 12/1997 Hillbish et al. ..... 439/939

* cited by examiner

*Primary Examiner*—Gary F. Paumen
(74) *Attorney, Agent, or Firm*—Wei Te Chung

(57) ABSTRACT

An audio jack connector comprises an insulative housing defining a receiving space for receiving signal contacts and other elements therein. A columnar projection extends from a front mating surface of the housing and a metal bushing is received in the columnar projection. Opposite the columnar projection, a recessed space is formed at the rear side of the housing for receiving a capacitor to filter interference noise from signals transmitted through the connector. Signal contacts and a pair of springs are all received in the receiving space of the housing. A grounding contact is mounted at a front side of the receiving space and makes electrical contact with the bushing. All contacts have soldering elements extending through a bottom of the housing for soldering to a circuit board. A grounding clip comprises a fixing portion received in a corresponding fixing slot in the housing, a connecting portion interconnecting the fixing portion and a resilient arm. The resilient arm comprises a base plate slantwise extending from the connecting portion, and a grounding tip formed at a free end of the resilient arm for electrically contacting a metal panel to discharge static electricity accumulated on the audio jack connector.

1 Claim, 7 Drawing Sheets

AUDIO JACK CONNECTOR

BACKGROUND OF THE INVENTION

The present invention relates to an audio jack connector, and particularly to an audio jack connector having a grounding clip for electrically contacting a mating plug connector to discharge static electricity accumulated thereon.

DESCRIPTION OF THE PRIOR ART

A conventional audio jack connector is mounted on a circuit board for mating with an external plug for signal transmission. Related inventions are disclosed in Taiwan Patent Application Nos. 82207507 and 86201643.

Referring to FIGS. 1 and 2, a conventional audio jack connector 1 has a metal shell 2 and four signal contacts 100, 102, 103, 104. The metal shell 2 has a mating face 10 for electrically contacting a metal panel (not shown) to discharge static electricity accumulated on the audio jack connector 1. A mating plug 3 is inserted into the audio jack connector 1 for electrically contacting corresponding contacts 100 and 103 for signal transmission. The grounding contact 101 is used for conducting static electricity to a circuit board. The signal contact 100 is pressed downward after the plug 3 is inserted into the audio jack connector 1 and may become deformed by the action of the inserted plug 3. The mating face 10 of the audio jack connector 1 is planar, and the electrical contact between the mating face 10 and the metal panel is not reliable. Therefore, static electricity accumulated on the audio jack connector 1 may not be properly discharged and signal transmission between the audio jack connector 1 and the plug 3 may have static interference.

Thus, there is a need for an improved audio jack connector to provide reliable signal transmission.

BRIEF SUMMARY OF THE INVENTION

A main object of the present invention is to provide an audio jack connector having a grounding clip for electrically contacting a metal panel to discharge static electricity accumulated on the audio jack, thereby providing efficient EMI shielding.

Another object of the present invention is to provide an audio jack connector having a signal contact formed with a rib for strengthening the signal contact and preventing deformation when engaging with an inserted plug.

To fulfill the above-mentioned objects, a preferred embodiment of the present invention is an audio jack connector comprising an insulative housing defining a receiving space for receiving signal contacts and other elements therein. A columnar projection extends from a front mating surface of the housing and a metal bushing is received in the columnar projection. Opposite the columnar projection, a recessed space is formed at the rear side of the housing for receiving a capacitor to filter interference from signals transmitted through the connector. Three positioning posts are respectively formed in the receiving space for engaging with corresponding receiving holes of a cover. Signal contacts and a pair of springs are all received in the receiving space of the housing. The signal contacts are respectively designated as first contact, second contact, third contact, fourth contact and grounding contact. The first and second contacts are mounted in the upper portion of the receiving space. The first contact electrically contacts the second contact by the action of the upper spring. The third contact and the fourth contact are mounted in the lower portion of the receiving space. The third contact has a contacting plate for electrically contacting the fourth contact. The fourth contact has a bent portion and a rib connected to the bent portion for strengthening the bent portion and preventing the fourth contact from becoming deformed. The grounding contact comprises an opening for engaging with the corresponding metal bushing, a folded portion extending from a base portion for engaging with a recessed platform in the front wall, a soldering portion extending from the base portion for soldering on a circuit board, and a positioning tip formed adjacent to the soldering portion for engaging with a receiving slot in the housing.

A grounding clip comprises a fixing portion received in a corresponding fixing slot of the housing, a connecting portion connecting the fixing portion with a resilient arm. The fixing portion defines a camber portion for electrically contacting the corresponding metal bushing after assembly. The resilient arm comprises a base plate extending slantwise from the connecting portion, and a grounding tip formed at a free end of the resilient arm for electrically contacting a metal panel to discharge static electricity accumulated on the audio jack connector.

Other objects, advantages and novel features of the invention will become more apparent from the following detailed description when taken in conjunction with the accompanying drawings.

DETAILED DESCRIPTION OF THE INVENTION

Figure 1:
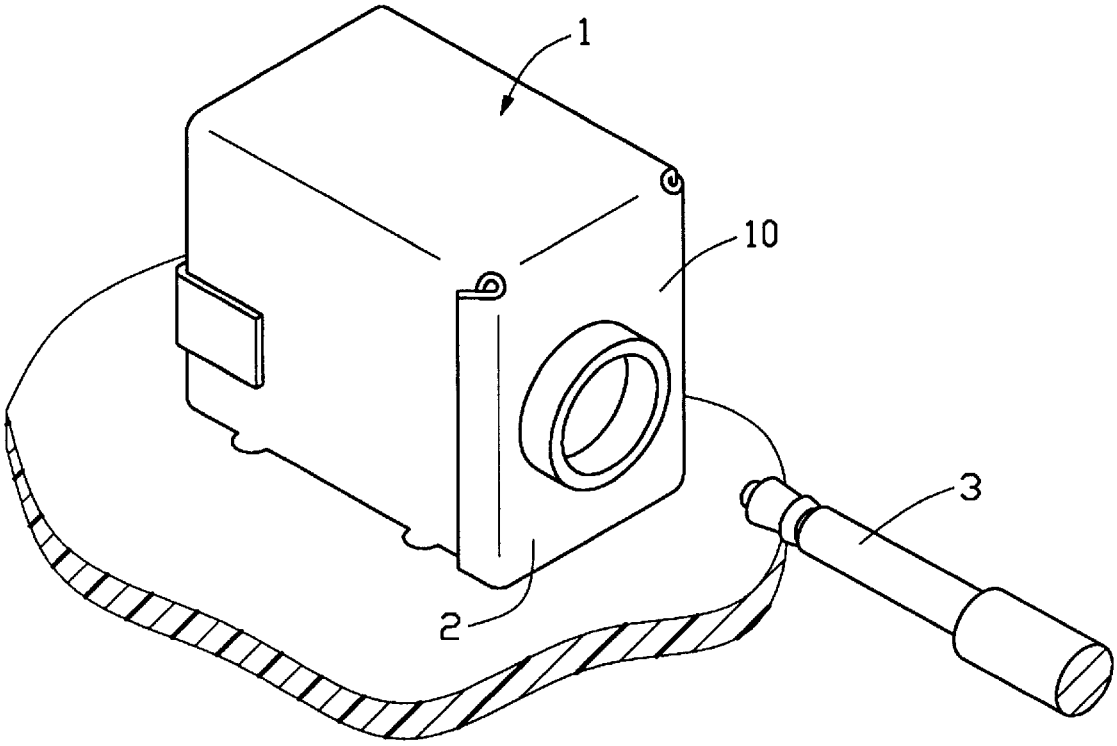
FIG. 1 (PRIOR ART)
FIG. 1 is a perspective view of a conventional audio jack connector and a plug.
Figure 2:
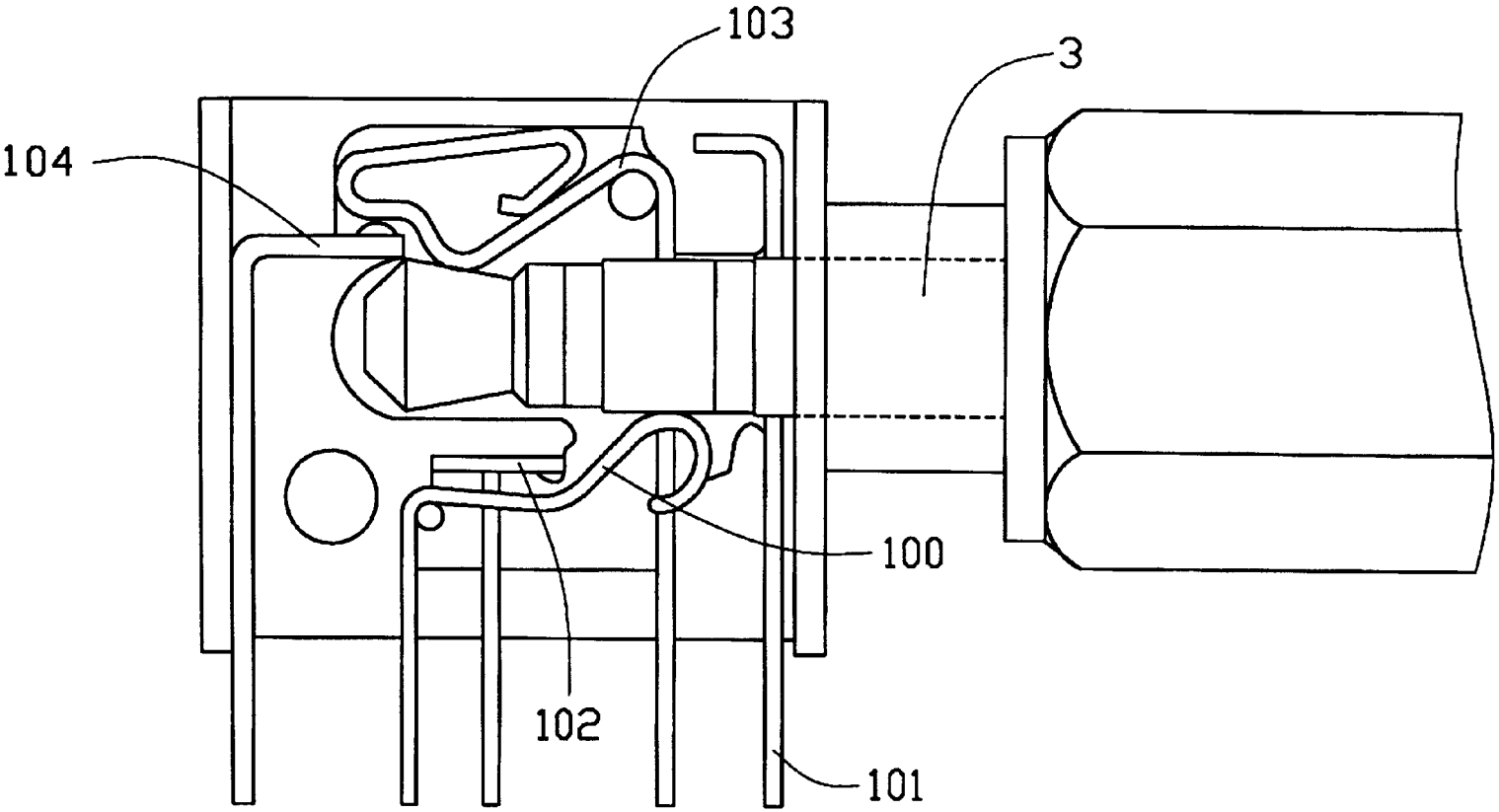
FIG. 2 (PRIOR ART)
FIG. 2 is a side view of a conventional audio jack connector assembled with a plug.
Figure 3:
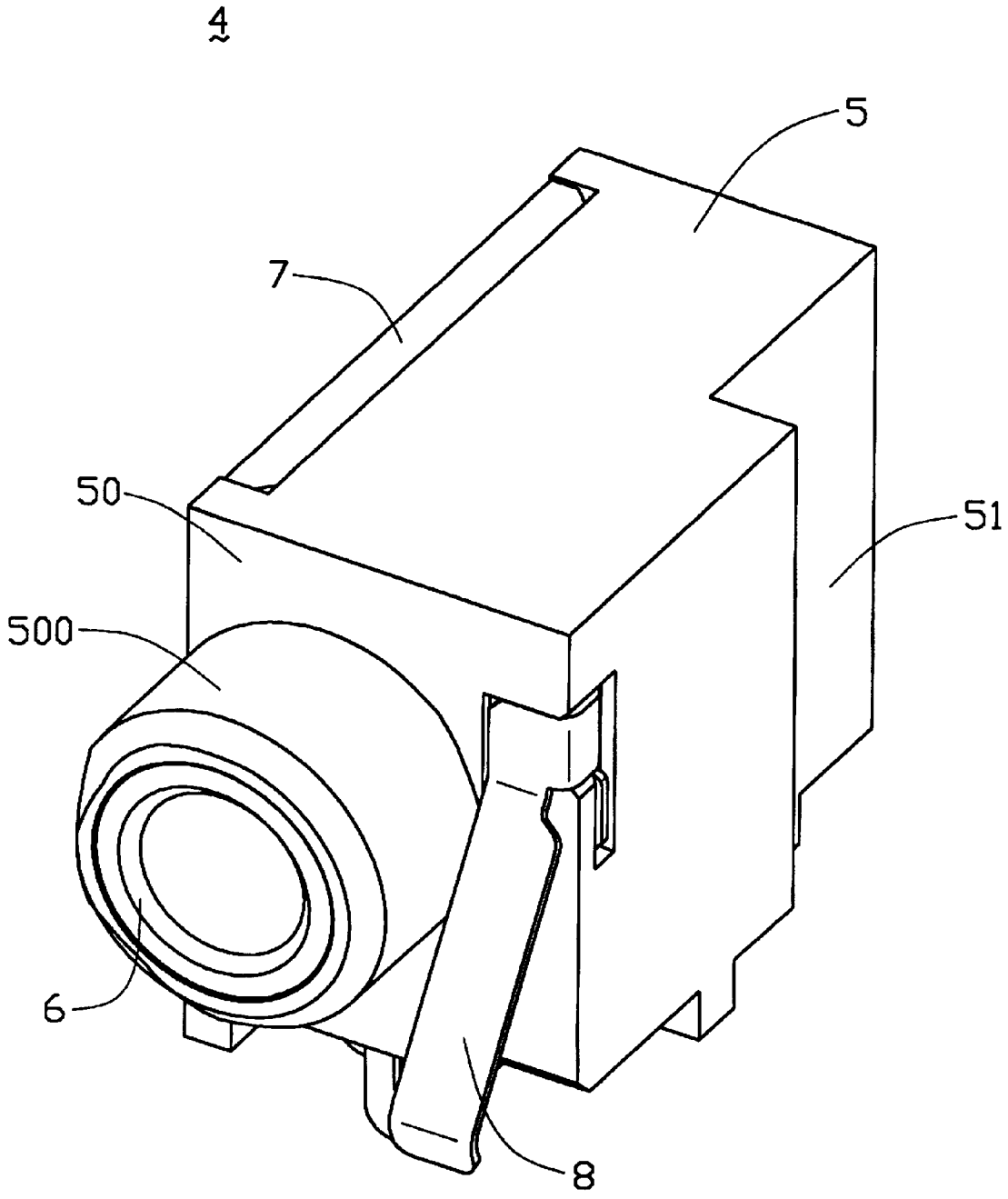
FIG. 3 is a perspective view of an assembled audio jack connector in accordance with the present invention.
Figure 4:
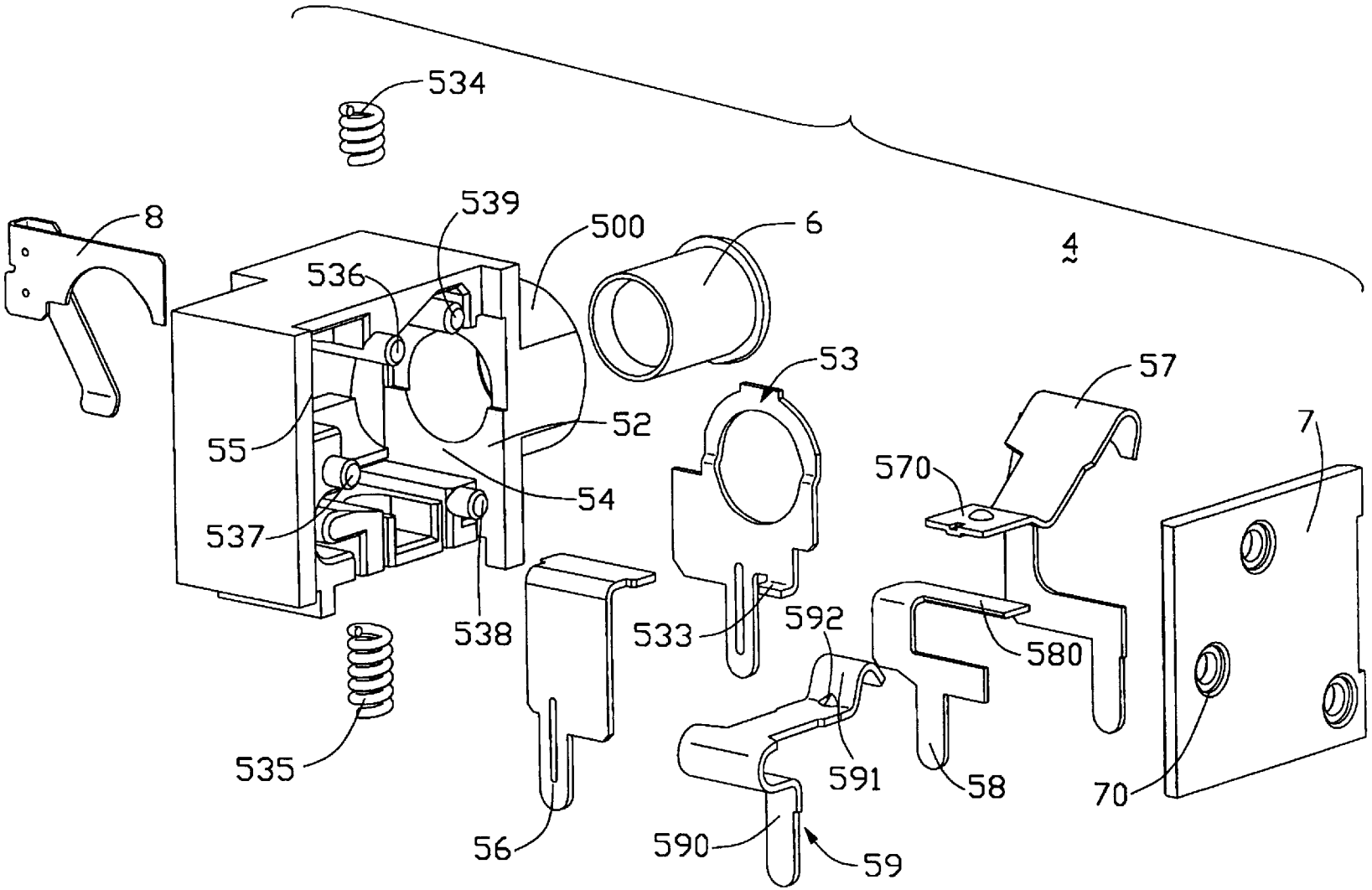
FIG. 4 is an exploded view of the audio jack connector in accordance with the present invention.

Referring to FIGS. 3 and 4, an audio jack connector 4 is used for connecting with an external plug (not shown) for audio signal transmission. The audio jack connector 4 comprises an insulative housing 5 defining a receiving space 52 for receiving signal contacts and other elements therein. A columnar projection 500 extends from a front mating surface 50 of the housing 5 and a metal bushing 6 is received in the columnar projection 500. Opposite the columnar projection 500, a recessed space 51 is formed at the rear side of the housing 5 for receiving a capacitor (not shown) to filter interference from signals. Positioning posts 536, 537, 538 and 539 are respectively formed in the receiving space 52 for engaging with corresponding receiving holes 70 defined in a cover 7. Signal contacts 53, 56, 57, 58, 59 and a pair of springs 534, 535 are all received in the receiving space 52 of the housing 5.

Figure 5:
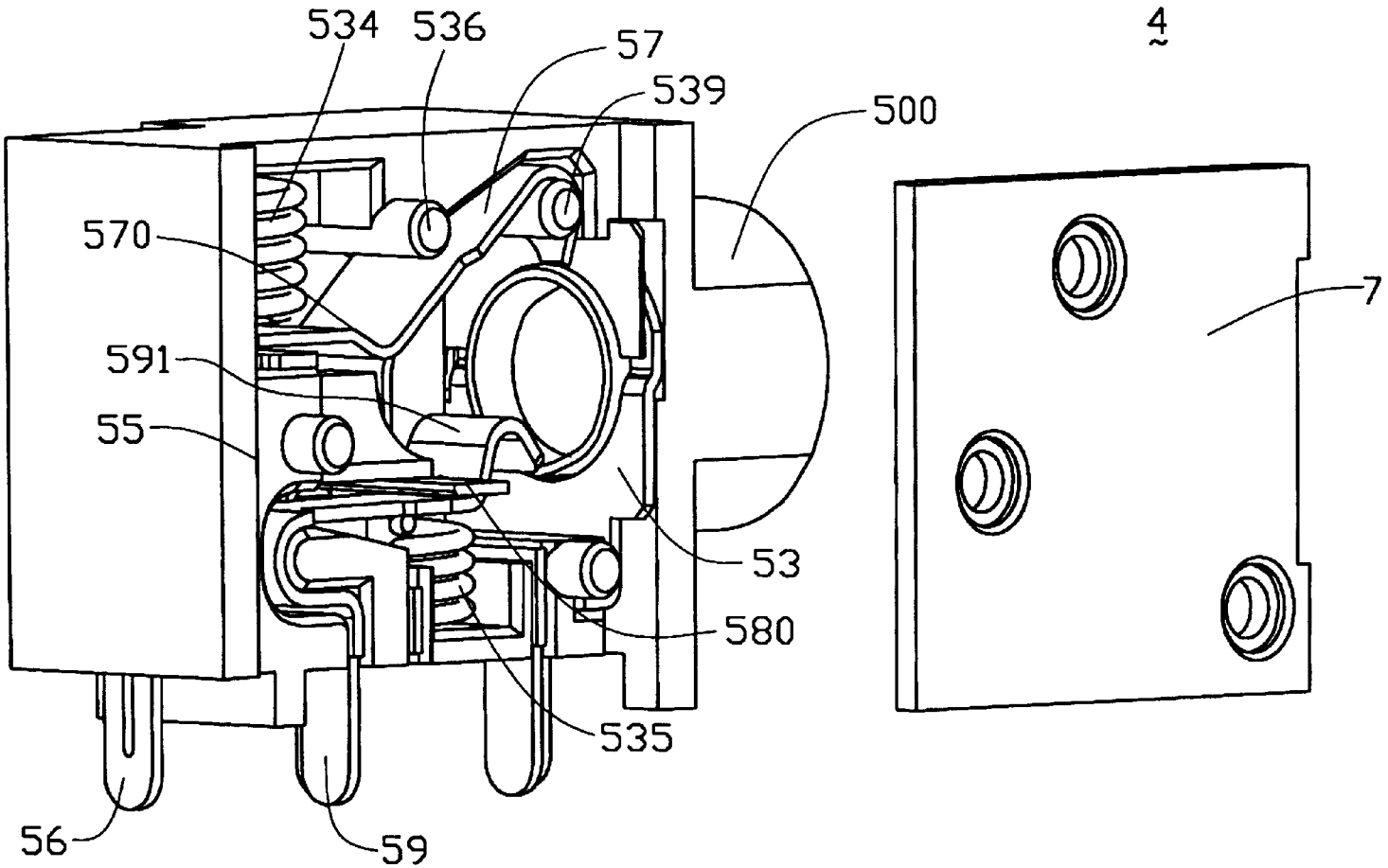
FIG. 5 is a perspective, side view of the assembled audio jack connector with a side cover.

Referring to FIGS. 4 and 5, the signal contacts are respectively designated as first contact 56, second contact 57, third contact 58, fourth contact 59 and grounding contact 53. The first and second contacts 56, 57 are mounted in the upper portion of the receiving space 52 and the other ends of the first and second contacts 56, 57 extend downwardly from the receiving space 52 to be soldered to a circuit board. The first contact 56 is fixed to a rear wall 55 and the second contact 57 is positioned by a positioning post 539 and a front wall 54 of the housing 5. Before insertion of the external plug, the first contact 56 contacts the second contact 57 under a force exerted by the upper spring 534. After the insertion of the external plug, a contacting portion 570 of the second contact 57 is raised, breaking contact with the first contact and electrically contacts the plug. The third contact 58 and the fourth contact 59 are mounted in a lower portion of the receiving space 52. The fourth contact 59 has a bent portion 591 and a solder portion 590. A rib 592 connects with the bent portion 591 for strengthening the bent portion and preventing the fourth contact 59 from being deformed. Before the insertion of the plug, the fourth contact 59 is raised by the lower spring 535 and contacts a contacting plate 580 of the third contact 58. After the insertion of the plug, the bent portion 591 is pressed downwardly by the plug and the fourth contact 59 separates from the contacting plate 580.

Figure 6:
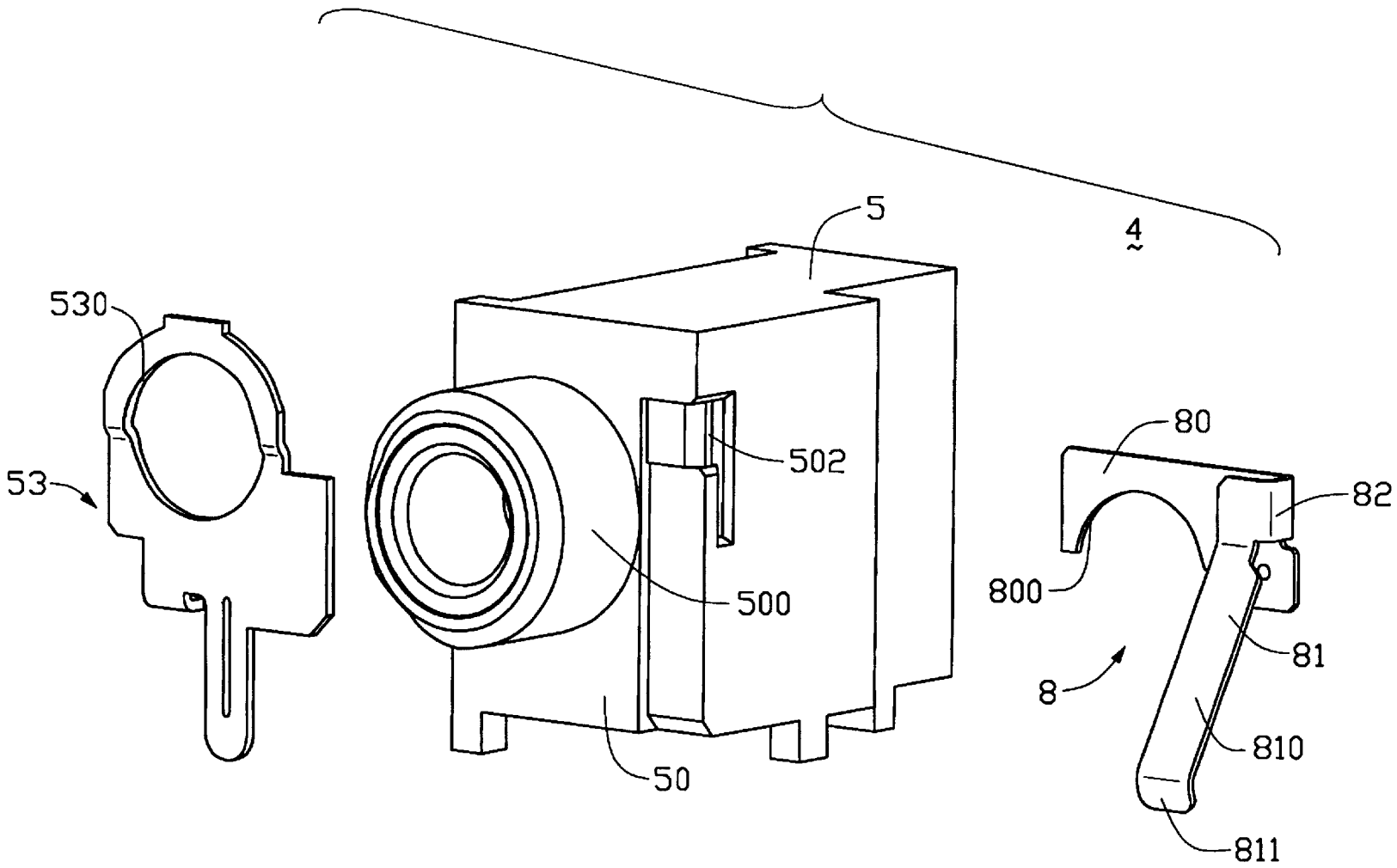
FIG. 6 is a perspective view of the audio jack connector housing with a grounding clip and a grounding contact.
Figure 7:
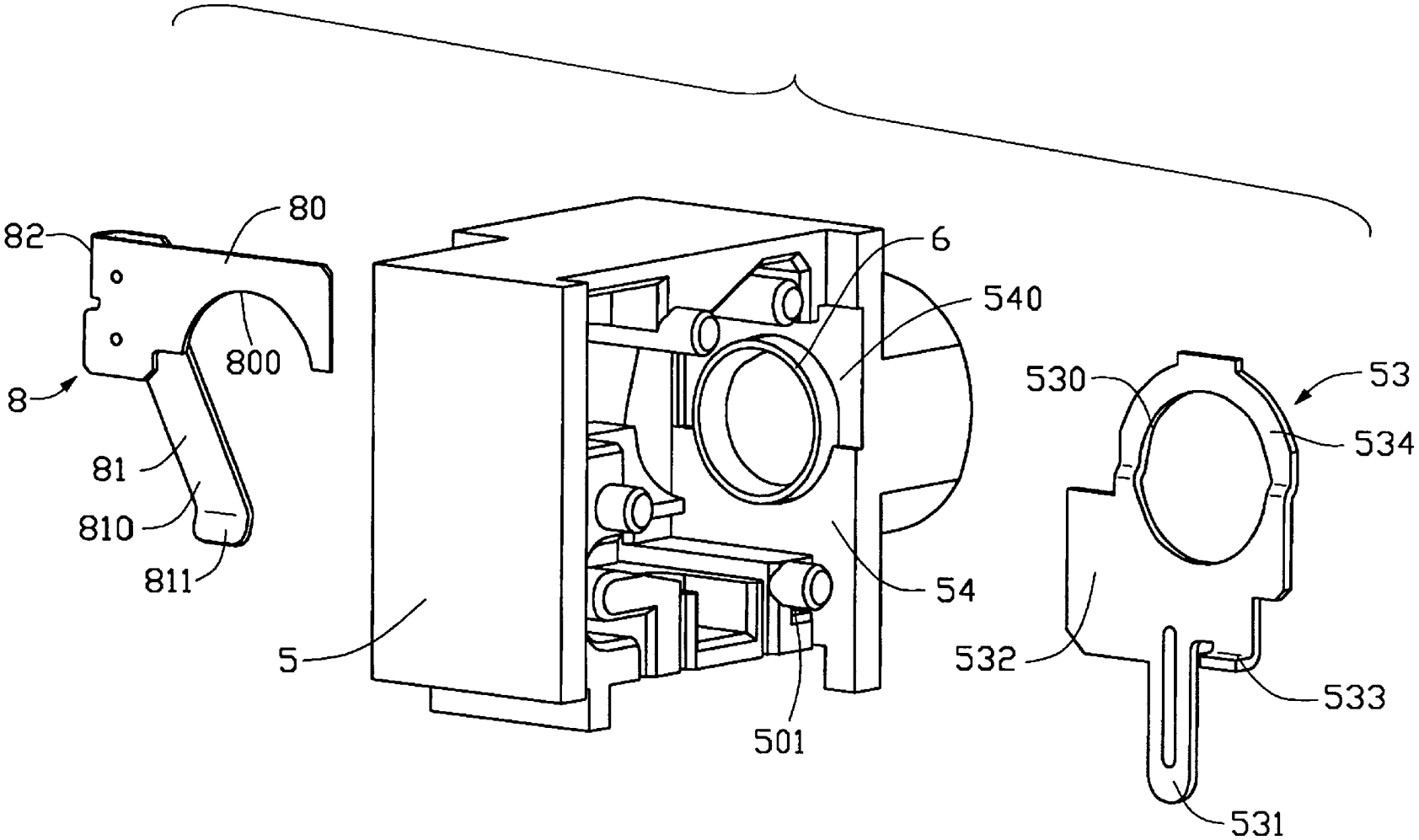
FIG. 7 is a rear side view of FIG. 6.

Referring to FIGS. 6 and 7, the grounding contact 53 comprises an opening 530 for engaging with the corresponding metal bushing 6, a folded portion 534 extending from a base portion 532 for engaging with a recessed platform 540 in the front wall 54. A soldering portion 531 extends from the base portion 532 for soldering on a circuit board, and a positioning tip 533 is formed adjacent to the soldering portion 531 for engaging with a receiving slot 501 of the housing 5.

The grounding clip 8 comprises a fixing portion 80 received in corresponding fixing slot 502 of the housing 5, a connecting portion 82 interconnecting the fixing portion 80 and a resilient arm 81. The fixing portion 80 defines a camber portion 800 for electrically contacting corresponding bushing 6 after assembly. The resilient arm 81 comprises a base plate 810 extending slantwise from the connecting portion 82, and a grounding tip 811 formed at a free end of the resilient arm 81 for electrically contacting a metal panel to discharge static electricity accumulated on the audio jack connector 4.

Thus, the grounding function is reliable and signal transmission quality is improved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An audio jack connector comprising:

an insulative housing having a columnar projection extending from a front mating face thereof for receiving a mating plug and a fixing slot formed in a side wall thereof;

a metal bushing being received in the columnar projection;

a plurality of signal contacts and a grounding contact being received in the insulative housing, the signal contacts comprising first and second contacts positioned in an upper portion of the housing, and third and fourth contacts positioned in a lower portion of the housing, the second contact electrically contacting the first contact, the fourth contact electrically contacting the third contact, each contact having a soldering portion for soldering to a circuit board; and a grounding clip comprising a fixing portion received in the fixing slot of the housing, a connecting portion interconnecting the fixing portion and a resilient arm extending forward for electrically contacting a metal panel, the fixing portion forming a camber portion for electrically contacting both the metal bushing and the grounding contact;

further comprising upper and lower springs respectively received in upper and lower portions of the housing;

wherein the grounding contact forms an opening for engaging with the metal bushing;

wherein the resilient arm forms a grounding tip at a free end thereof;

wherein the second and the fourth contacts are urged to disengage from the first and the third contacts, respectively, upon insertion of a mating plug into the insulative housing;

wherein the fourth contact forms a rib to strengthen the fourth contact and prevent the fourth contact from being deformed by the mating plug;

wherein the rib is disposed on the fourth contact connecting with the bent portion;

wherein the insulative housing forms a recessed space for receiving a capacitor thereby occupying less space on the circuit board.

* * * * *